US007341439B2

(12) United States Patent
Nakayama et al.

(10) Patent No.: US 7,341,439 B2
(45) Date of Patent: Mar. 11, 2008

(54) SCROLL FLUID MACHINE HAVING AN ADIABATIC EXPANSION CHAMBER

(75) Inventors: Takamitsu Nakayama, Yokohama (JP); Takashi Serita, Tokyo (JP)

(73) Assignee: Anest Iwata Corporation, Kohoku-ku, Yokohama-shi (JP)

( * ) Notice: Subject to any disclaimer, the term of this patent is extended or adjusted under 35 U.S.C. 154(b) by 0 days.

(21) Appl. No.: 11/708,655

(22) Filed: Feb. 20, 2007

(65) Prior Publication Data

US 2007/0196226 A1 Aug. 23, 2007

(30) Foreign Application Priority Data

Feb. 21, 2006 (JP) ..... 2006-043703

(51) Int. Cl.
*F03C 2/00* (2006.01)
*F04C 18/00* (2006.01)

(52) U.S. Cl. ..... 418/55.2; 418/55.1; 418/60; 418/83

(58) Field of Classification Search ..... 418/15, 418/55.1, 55.2, 59, 60, 83
See application file for complete search history.

(56) References Cited

U.S. PATENT DOCUMENTS 6,338,912 B1 * 1/2002 Ban et al. ..... 429/34
6,716,009 B2 * 4/2004 Sowa et al. ..... 418/55.1
2005/0031469 A1 * 2/2005 Yanagisawa et al. ..... 418/60

FOREIGN PATENT DOCUMENTS

JP 2001329970 A * 11/2001
JP 2004-28033 A 1/2004

* cited by examiner

*Primary Examiner*—Theresa Trieu
(74) *Attorney, Agent, or Firm*—Davis Bujold & Daniels, P.L.L.C.

(57) ABSTRACT

A scroll fluid machine comprises a driving shaft having an eccentric axial portion at one end; a fixed scroll having a fixed wrap; and an orbiting scroll having an orbiting wrap and rotatably mounted to the eccentric axial portion of the driving shaft. A gas introduced through an inlet on the outer circumference of the fixed scroll is compressed by a compression chamber between the fixed and orbiting wraps towards the center and discharged through an outlet close to the center. Between the eccentric axial portion and the innermost winding portion of the fixed wrap, an adiabatic expansion chamber is formed thereby cooling the compressed gas right before discharging.

1 Claim, 4 Drawing Sheets

SCROLL FLUID MACHINE HAVING AN ADIABATIC EXPANSION CHAMBER

This application claims priority from Japanese Application Serial No. 2006-43703 filed Feb. 21, 2006.

BACKGROUND OF THE INVENTION

The present invention relates to a scroll fluid machine such as a scroll vacuum pump or a scroll compressor.

As disclosed in JP2004-28033A, a scroll fluid machine comprises a fixed scroll having a spiral fixed wrap and an orbiting scroll having a spiral orbiting wrap. The orbiting scroll is revolved by a driving shaft while the fixed wrap engages with the orbiting wrap. A compression chamber formed between the fixed and orbiting wraps is gradually decreased in volume and moved towards the center, thereby compressing a compression medium such as a gas sucked through an inlet in the outer circumference and discharging it through an outlet at the center.

The compression medium is compressed towards the center, so that the temperature of the center rises compared with the outer circumference. Thus, it is necessary to cool a central part so as to prevent a rotary part of the driving shaft and orbiting scroll such as bearings or seal member from deteriorating owing to heat.

However, in the scroll fluid machine, if the compression medium is a toxic gas that contaminates natural environment, it is necessary to use a sealed structure in which the driving shaft and surroundings thereof are completely sealed by a cover to prevent the compression medium from leaking to outside.

It is difficult to cool the inside of the sealed structure. So cooling is carried out by an external fan disposed outside. However, a central part cannot be cooled although outer parts are cooled. So heat is likely to deteriorate bearing or sealing members to make durability poor.

SUMMARY OF THE INVENTION

In view of the disadvantages, it is an object of the invention to provide a scroll fluid machine in which a central part can be cooled effectively.

BRIEF DESCRIPTION OF THE DRAWINGS

The features and advantages of the invention will become more apparent from the following description with respect to an embodiment as shown in accompanying drawings wherein.

DETAILED DESCRIPTION PREFERRED EMBODIMENTS

Figure 1:
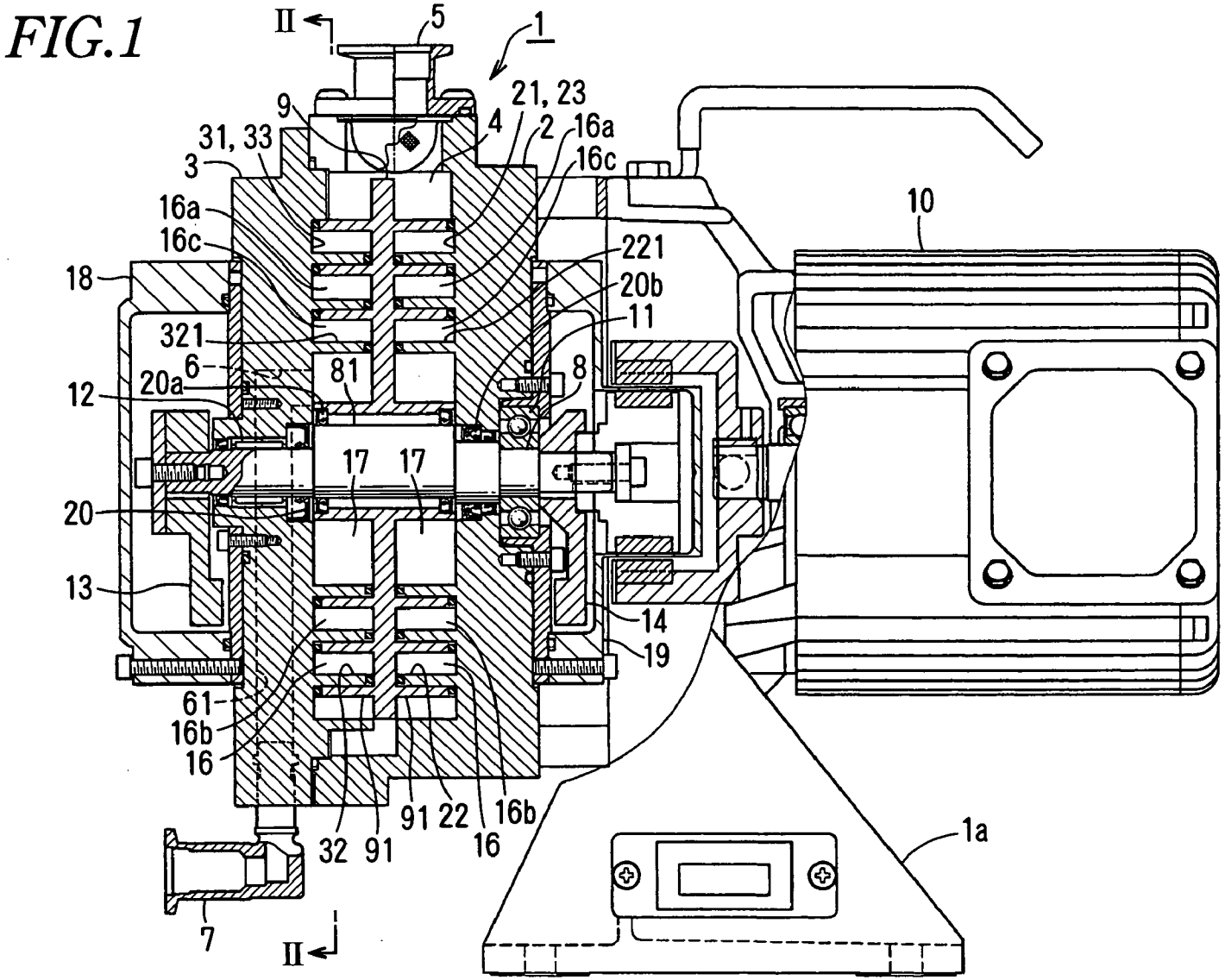
FIG. 1 is a vertical sectional view showing one embodiment of a scroll fluid machine according to the present invention.

A housing 1 comprises a rear casing 2 and a front cover 3 to form a sealed cylindrical chamber 4. An inlet 5 for sucking a gas from an external tank (not shown) into the chamber 4 is formed on the upper outer circumference, and an outlet 6 for discharging a compressed gas from the chamber 4 is formed in the center.

The outlet 6 is connected to a discharge tube 7 in the lower outer circumference of the cover 3 via a discharge path 61 extending downwards. The housing 1 and a motor 10 described below are mounted to a support la partially shown in FIG. 1.

The casing 2 and the cover 3 have circular fixed end plates 21,31 facing each other. The opposite surfaces of the fixed end plates 21,31 have involute-curve-like spiral fixed wraps 22,32 to form fixed scroll 23,33.

In the sealed chambers 4 between the fixed wraps 22 and 32, there is an orbiting scroll 9 which is rotatably supported around an eccentric axial portion 81 of a driving shaft 8 rotatably mounted in the center of the housing 1.

On each side of the orbiting scroll 9, orbiting wraps 91,91 are provided respectively to engage with the fixed wraps 22, 32 with 180 degree shifting, and the orbiting scroll 9 is connected to the fixed end plate 31 via a known pin-crank-type self-rotation preventing device 15.

The driving shaft 8 is connected to the motor 10 as drive source at the rear end and rotatably supported by bearings 11, 12 in the center of each of the fixed end plates 21, 31.

Between the outer circumferential surface of the driving shaft 6 and the casing 2 or the cover 3, seals 20, 20*a*, 20*b* are provided to prevent a gas from leaking.

A the front and rear ends which project from the fixed end plates 31, 21 of the driving shaft 8, balance weights 13, 14 are secured to rotate together with the driving shaft 8 making rotation of the driving shaft 8 smooth.

Over the rear surface of the casing 2 and over the front surface of the cover 3, covering members 18, 19 are mounted to cover the projecting ends of the driving shaft 8 from the housing and the balance weights 13, 14. The covering members 18, 19 prevent a compressed gas in the chamber 4 from leaking.

The orbiting scroll 9 is revolved by rotating the driving shaft 8 by the motor 10 while the orbiting wraps 91, 91 engage with the fixed wraps 22, 32. Thus, a plurality of compression chambers 16, 16*a*, 16*b*, 16*c* between the fixed wraps 22, 32 and the orbiting wraps 91, 91 are moved towards the center as the volume of the compression chamber reduces gradually.

Within innermost winding portions 221, 321 of the fixed wraps 22, 32 of the fixed scrolls 23, 33 and around the eccentric axial portion 81 of the driving shaft 8, there are adiabatic expansion chambers 17, 17 for lowering temperature of gas compressed in innermost compression chambers 16*c*, 16*c* finally compressing a gas right before discharging from the outlet 6.

The adiabatic expansion chamber 17 is formed by removing an innermost winding of a known fixed wrap and is greater in volume than the innermost compression chamber 16*c*.

Figure 2:
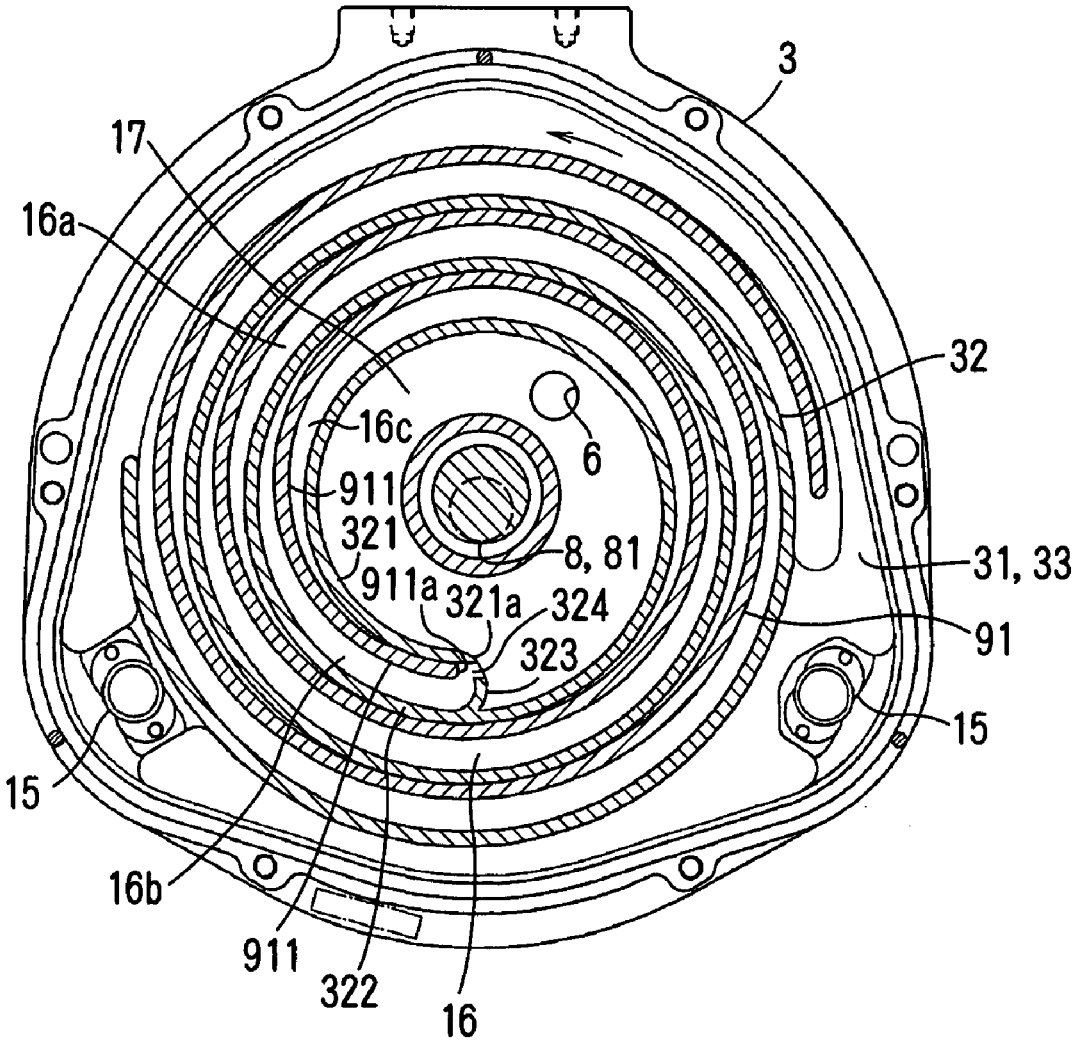
FIG. 2 is a vertical sectional view taken along the line II-II in FIG. 1.
Figure 3:
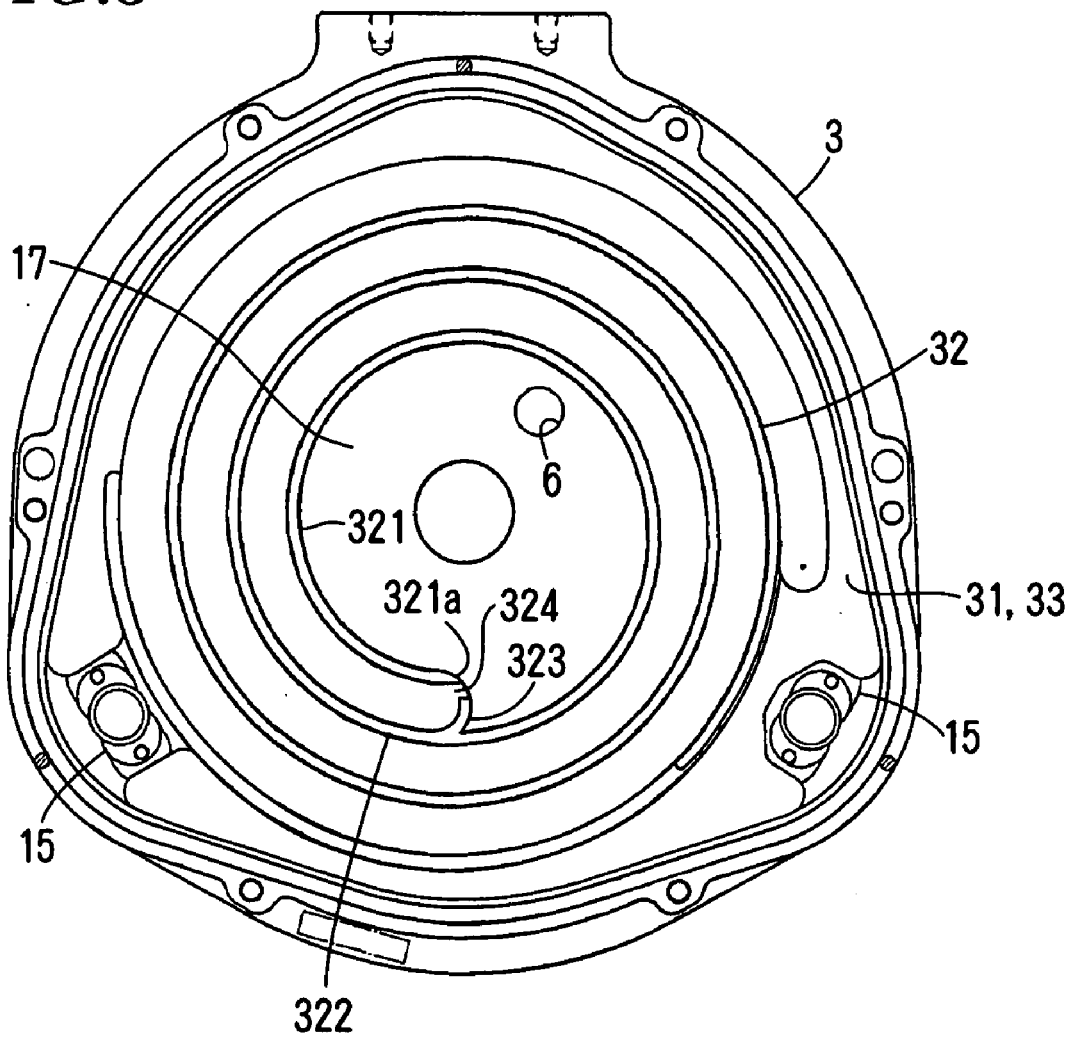
FIG. 3 is a front view of the inside of a fixed scroll.
Figure 4:
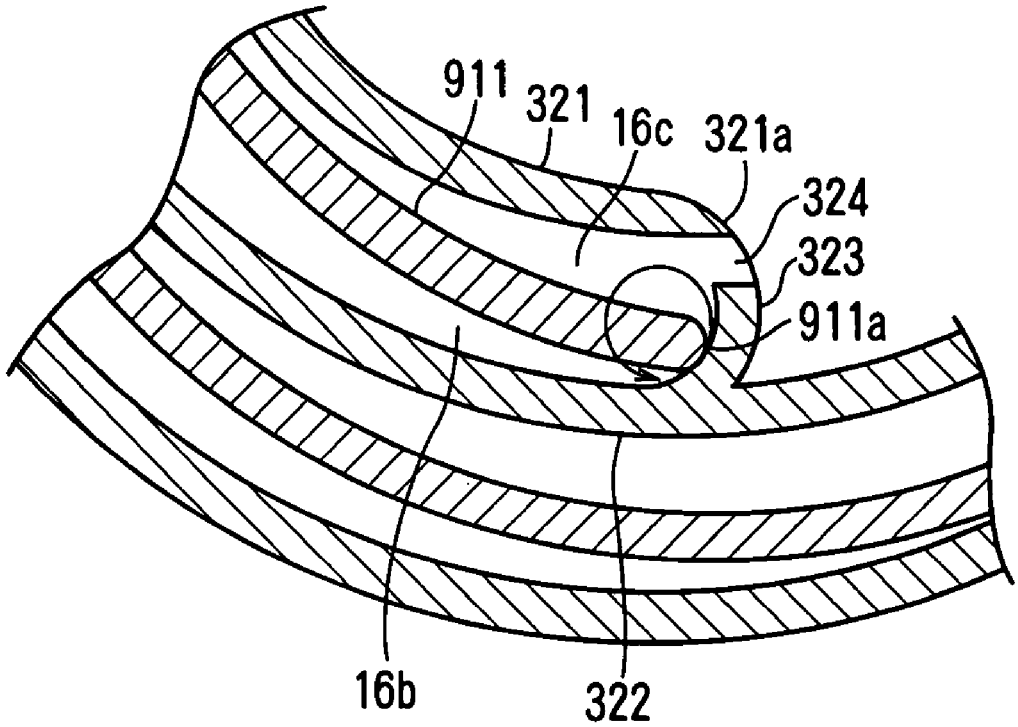
FIG. 4 is an enlarged front view of the main part.

As shown in FIGS. 2-4, between an winding end 321*a* of the innermost winding portion 321 of the fixed scroll 33 and an arcuate projection 323 on the inner circumferential surface of an outer winding part 322 of the innermost winding portion 321, there is formed an intake port 324 for introducing a gas compressed by the innermost compression chamber 16*c* into the adiabatic expansion chamber 17. In the fixed scroll 23 as well as in the fixed scroll 33, there are a projection and an intake port (not shown).

When a winding end 911*a* of an innermost winding portion 911 of the orbiting wrap 91 takes circular motion as shown by an arrow in FIG. 4 with revolution of the orbiting scroll 9, the winding end 911*a* comes in sliding contact with the projection 323 to define an innermost compression chamber 16*c* and an outer compression chamber 16*b*.

It will be described how to act in this embodiment.

When the fixed wraps 22, 32 engage with the orbiting wraps 91, 91, the orbiting scroll 9 is revolved with rotation of the driving shaft 8 by the motor 10 while a gas is sucked from an external tank through the inlet 5. Accordingly, each of the compression chambers 16, 16*a*, 16*b*, 16*c* moves towards the center while each volume gradually decreases thereby compressing gas sucked from the inlet 5. Gas finally compressed by the innermost compression chamber 16*c* is introduced into the adiabatic expansion chamber 17 through the intake port 324.

Gas in the adiabatic expansion chamber 17 adiabatically expands and falls in temperature because the volume of the adiabatic expansion chamber 17 is greater than that of the innermost compression chamber 16*c*, thereby cooling the eccentric axial portion 81 of the driving shaft 8 within the adiabatic expansion chamber 17, rotary parts of the orbiting scroll 9 such as the bearings 11, 12 and sealing members 20, 20*a*, 20*b* effectively. Gas introduced in the adiabatic expansion chamber 17 is discharged to outside or stored in an external tank (not shown) via the outlet 6, the discharge path 61 and the discharge tube 7.

Gas which is discharged from the outlet 6 of the adiabatic expansion chamber 16*c* is lower in temperature than gas compressed in the innermost compression chamber 16*c* thereby cooling part of the scroll fluid machine especially the discharge path 61 when it passes through the discharge path 61.

When gas compressed by the innermost compression chamber 16*c* is introduced in the adiabatic compression chamber 17, the winding end 911*a* of the orbiting wrap 91 gets in sliding contact with the projection 323 with the revolution of the orbiting scroll 9 thereby defining the innermost compression chamber 16*c* and the outer compression chamber 16*b*. Thus, gas compressed by the innermost compression chamber 16*c* can be surely introduced in the adiabatic expansion chamber 17 without flowing back to the outer compression chamber 16*b*.

The foregoing embodiment relates to a both-side scroll fluid machine where the both-side orbiting scroll 9 is disposed between the two fixed scrolls 23 and 23. The present invention may apply to a one-side scroll fluid machine where a one-side fixed scroll engages with a one-side orbiting scroll.

In the foregoing embodiment, the adiabatic expansion chamber 17 is disposed inside the innermost winding portions 221, 321 of the fixed wraps 22, 32 of the fixed scroll 23, 33. Instead, the innermost winding portion of the orbiting wrap 91 may engage within the innermost winding portions 221, 321 and the adiabatic expansion chamber 17 may be disposed within the innermost winding portion of the orbiting wrap 91. Similar advantages can be achieved as well.

The foregoing merely relates to an embodiment of the invention. Various changes and modifications may be made by a person skilled in the art without departing from the scope of claims wherein.

What is claimed is:

1. A scroll fluid machine comprising:

a driving shaft having an eccentric axial portion at one end;

a fixed scroll having a fixed wrap; and an orbiting scroll having an orbiting wrap and rotatably mounted around the eccentric axial portion of the driving shaft to form a compression chamber between the fixed and the orbiting wraps, the orbiting scroll being revolved by the driving shaft to reduce a volume of the compression chamber towards a center of the orbiting scroll thereby compressing a gas sucked from an outer circumference of the fixed scroll to discharge the gas through an outlet close to the center, and an adiabatic expansion chamber being formed between an innermost winding portion of the fixed wrap and the eccentric axial portion of the driving shaft:

wherein the adiabatic expansion chamber is greater in volume than an innermost compression chamber; and a projection is formed on an inner circumferential surface of an innermost winding portion of the fixed wrap, an inner end of the orbiting wrap coming in sliding contact with the projection thereby preventing compressed gas from flowing back to the compression chamber.

* * * * *